United States Patent [19]

Mahan

[11] 4,335,792

[45] Jun. 22, 1982

[54] WORKING BOARD FOR DRILLING RIG

[76] Inventor: Michael S. Mahan, Rte. 2, Box 149, Colorado City, Tex. 79512

[21] Appl. No.: 176,095

[22] Filed: Aug. 7, 1980

[51] Int. Cl.[3] ..... E21B 19/14

[52] U.S. Cl. ..... 175/52; 175/85

[58] Field of Search ..... 175/52, 85; 414/22

[56] References Cited

U.S. PATENT DOCUMENTS

| | | | |
|---|---|---|---|
| Re. 30,071 | 8/1979 | Hilding et al. | 175/52 |
| 2,576,803 | 11/1951 | Moore | 414/22 |
| 2,909,288 | 10/1959 | Boudette | 175/85 |
| 2,972,388 | 2/1961 | Thornburg | 175/52 |
| 3,145,802 | 8/1964 | Woolslayer et al. | 182/114 |
| 3,286,777 | 11/1966 | Gyongyosi | 175/52 |
| 3,696,944 | 10/1972 | Campbell | 414/22 |
| 3,840,128 | 10/1974 | Swoboda et al. | 414/22 |
| 3,965,994 | 6/1976 | Hilding | 175/52 |
| 4,061,233 | 12/1977 | Benjamin | 414/22 |

FOREIGN PATENT DOCUMENTS

| | | | |
|---|---|---|---|
| 592973 | 2/1978 | U.S.S.R. | 175/52 |

*Primary Examiner*—James A. Leppink

*Attorney, Agent, or Firm*—Wendell Coffee

[57] ABSTRACT

A working board is attached to an oil derrick for a workman to stand upon while racking pipe. The board has arcuate slots with inner floor members and pivoting door covers for use when pipe is not in the slots thereby substantially eliminating the possibility of a workman falling. Pusher arms move the pipe to ready access for making the string.

16 Claims, 6 Drawing Figures

WORKING BOARD FOR DRILLING RIG

CROSS REFERENCE TO RELATED APPLICATIONS

None.

BACKGROUND OF THE INVENTION (1) Field of the Invention

This invention relates to oil well working boards used to stand upon while connecting and disconnecting stands of drill pipe and more particularly to a board that has a substantial amount of floor area for a workman to stand upon.

(2) Description of the Prior Art

Commercially on the market before my invention, working boards utilized parallel finger racks several inches wide which formed storage spaces. Such boards had solid floor members on three edges and a solid center floor piece which extended from the outer side inward to the side connected to the drilling rig. However, there were many areas and spaces where the stands of drill pipe were worked in which a workman could step into and fall. When pipe stands were being stored or removed from the finger racks the workman had no mechanical means to aid him and the work was hard, physical and inherently unsafe. The pipe had to be tied by a rope to remain in the finger racks and a rope was not always effective.

Before this application was filed, a search was made in the U.S. Patent and Trademark Office and the following patents were found:

Moore U.S. Pat. No. 2,576,803
Boudette U.S. Pat. No. 2,909,288
Thornburg U.S. Pat. No. 2,972,388
Woolslayer U.S. Pat. No. 3,145,802
Gyongyosi U.S. Pat. No. 3,286,777
Swoboda U.S. Pat. No. 3,840,128
Benjamin U.S. Pat. No. 4,061,233
Hilding U.S. Pat. No. Re. 30,071

It would appear from these prior patents that none of them (except Moore and Woolslayer et al.) show a working board wherein a man manipulates drill stem pipe.

Woolslayer shows a platform having many pivoting rack fingers wherein a workman walks on the unused fingers.

Several automated devices employing semi-circular magazine type pipe holders are shown.

Hilding shows a drill string handling apparatus that has means for transferring the pipe but the invention does not utilize a workman standing on a platform. Gyongyosi shows a drill pipe storage handling system in the form of a semi-circular storage but there is no working board associated with the invention.

The other patents do not appear to be any more pertinent than those discussed above.

SUMMARY OF THE INVENTION (1) New and Different Function

I have invented an improved oil well working board platform for a workman to safely stand upon while connecting and disconnecting stands of drill pipe and racking the stands into the board. I have eliminated unsafe gaps and spaces which existing boards utilize and have, therefore, minimized the risk of fall to the workman who is racking drill pipe.

More particularly, arcuate slots which have an inner floor member and are connected to feed slots are used to rack and store pipe. Folding pipe slot doors are closed by the workman when the arcuate slots are not holding pipe. Thus, the working board has a minimum amount of open space into which a workman might step and fall. The slots provide a secure means of pipe storage. Pipe pushers, which are powered by an air cylinder, aid the workman to mechanically move the drill pipe around the arcuate slots to feed slots.

Therefore, it may be seen that the total function of all the parts is far greater than the sum of the functions of the individual metal floor, slots, door covers, air cylinders, beams, etc.

(2) Objects of this Invention

An object of this invention is to provide a pipe racking platform for the derrick worker to walk on while working pipe.

Another object of this invention is to provide a mechanical means of storing and retrieving drill pipe.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
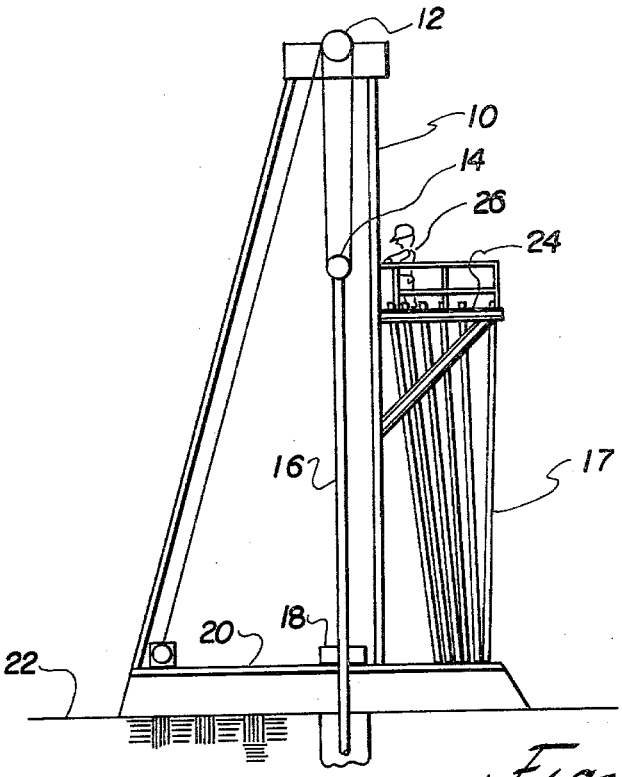
FIG. 1 is a schematic representation of my invention with an oil derrick.

Referring to FIG. 1, there may be seen an oil derrick 10 having a crown block 12 suspending a traveling block 14. A string of drill pipe 16 is suspending from the traveling block 14 through a rotary table 18 in drilling floor 20. Said drill pipe string extends downward through the drilling floor 20 and into the ground 22. A working board 24 is attached to the derrick 10. A workman 26 typically stands on his working board 24 and attaches or removes drill pipe stands 17 from the string 16. The drill pipe may be racked and stored extending from the working board 24 to the drill floor 20.

Since the workman 26 is positioned at a high elevation, it is necessary that all possible precautions be taken to insure against his slipping, tripping or falling while on the working board. Working boards with finger type racks present an unneeded danger even for workers with safety belts. Hand rails are standard equipment although not identified. The description to this point is old and well known to the oil well drilling art.

Figure 2:
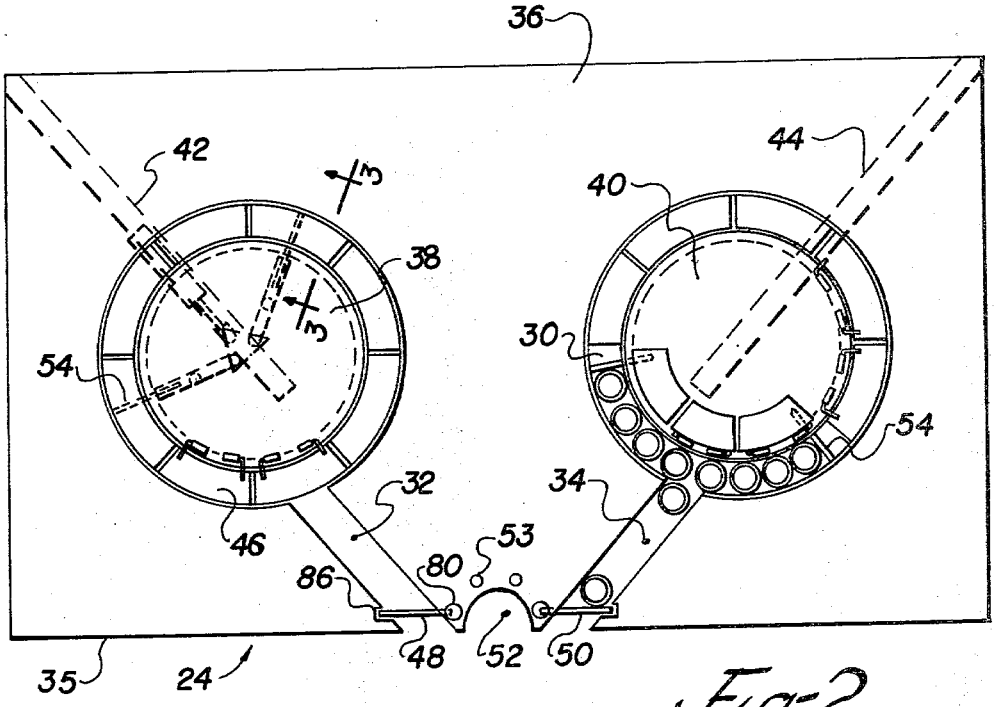
FIG. 2 is a top plan view of an embodiment of this invention.

My working board 24 has arcuate or circular slots 28 and 30 connected to the outside of the board by elongated slots 32 and 34. One edge 35 of the working board 24 shown in FIG. 2 attaches to the derrick 10 so that the elongated feed slots 32 and 34 open to the derrick side of the board. Edge 35 is the side of the working board 24 adjacent to the string 16. The working board 24 has an outer or main floor member 36 and inner floor members 38 and 40. Said inner floor members are supported by beams 42 and 44 extending from the outside corners of the working board 24.

Pivotal doors 46 are pivoted on the inner floor members 38 and 40. The doors 46 extend around the circular slots 28 and 30. These doors open onto the inner floor member when the drill pipe is present in the circular slots. Whenever said circular slots are vacant of pipe, the pivotal doors can be closed to cover the circular slots, and close a hole where the workman 26 might fall into. The circular slots 28 and 30 and the feed slots 32 and 34 have a width of at least the diameter of the drill pipe 17 but not greater than thrice the drill pipe's diameter. The drill pipe may be racked single file as illustrated or double file. The circular storage slot 28 might be thought of as two slots, one to the right of elongated feed slot 32 and the other to the left.

Latches 48 and 50 are at the entrance or derrick side or side adjacent to the string of the feed slots 32 and 34. Since the drill pipe string is worked at this edge of the elongated or feed slots, pipe can possibly slip from the elongated slots. Therefore, the latches 48 and 50 usually remain closed to prevent this from happening and to prevent drill pipe from inadvertently entering the elongated slots. A cow catcher 52 is an arcuate notch which may be used for temporary placement of the drill pipe before it is strung on the string or stored in the circular storage slots 28 and 30.

Once the drill pipe has passed through the latches 48 and 50 and is in the storage slots, the pipe is moved toward the beams 42 and 44.

An air switch 53 is adjacent the cow catcher 52. When the workman 26 steps on the switch 53 the swing arm assembly 54 is made to rotate through the arcuate slot 28 toward the elongated feed slot 32.

Figure 3:
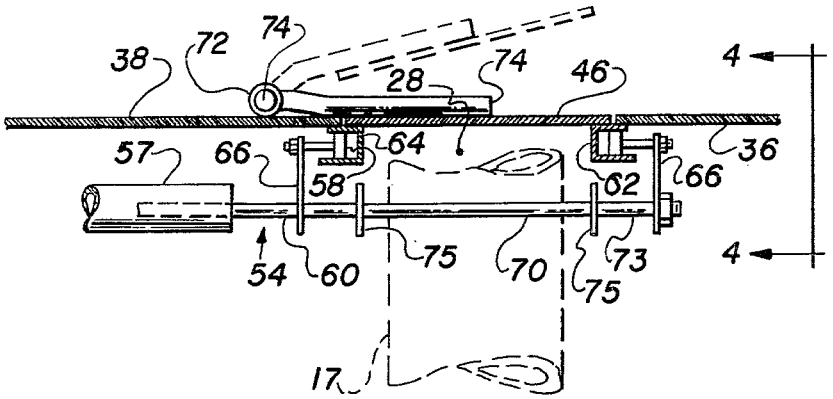
FIG. 3 is a side sectional view of the swing arm and arcuate slot, taken substantially on line 3—3 of FIG. 2.

As may be seen in FIG. 3, the swing arm assembly 54 travels by means of the rollers 58 along the tracks 62 and 64. Track 62 is attached to the inside of the outer floor member 36, along storage slot 28. It extends slightly beyond the outer floor member 36 so that the edge of the track 62 actually defines the slot 28. The track 64 is attached to the outer edge or perimeter of the inner floor member 38. It also projects slightly beyond the edge of the member 38 so that it too defines the other side of the slot 28. The swing arm assembly 54 includes the swing arm tube 57 and the swing telescoped arm 60 telescoped within the tube 57. Plates or holders 66 are connected as by welding around the swing telescoped arm 60. Two of the plates or holders 66 are used. One holder is on the outside of track 62 and the other on the inside of track 64 so that the holders or plates 66 bracket the tracks. The rollers 58 are supported by a shaft suitably attached to the plates 66. Extension arm 73 is telescoped around the swing telescoped arm 60 and projects inward toward the slot from the holder plate 66. It is securely attached as by welding to the holder plate 66. On the inboard end of the extension arm 73 a pipe guide 75 is attached. The pipe guide will also be slightly inboard of the tracks 62 and 64.

Figure 4:
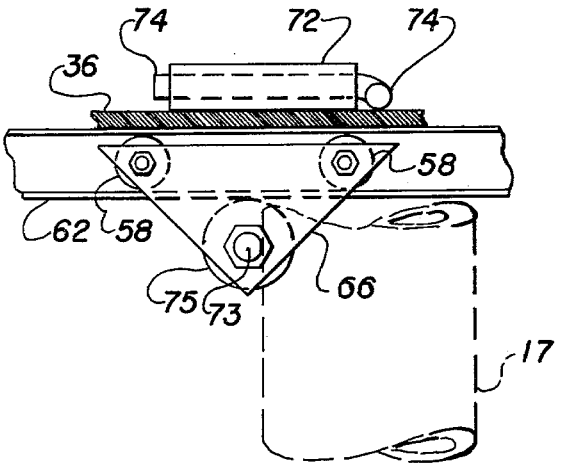
FIG. 4 is an end sectional view of the swing arm and arcuate slot, taken substantially on line 4—4 of FIG. 3.

The pipe guides 75 make contact with the drill pipe (shown in broken lines in FIGS. 3 and 4) and prevent the pipe from rotating and bunching up in the circular slots.

Protector sleeve 70 is telescoped over the swing telescoped arm 60 between the pipe guides 75 to protect the swing telescoped arm between the pipe guide 75.

Door 46 covers the circular slot 28. Round tubing 72 is attached to the inner floor member 38 as by welding. Cold rolled bar 74 is attached to the door 46 by welding. As may be seen, the cold rolled bar is L-shaped and a portion thereof is journalled within the round tubing 72 to form the hinge for the doors.

The swing telescoped arm 60 and extension arm 73 extend through the bottom hole of holder plate 66. The shaft of the rollers 58 extend through the top holes. Above track 62 is the outer floor member 36 and above track 64 is the inner floor member 38. The door 46 rests on the tracks 62 and 64 when it is closed. When all the doors are opened onto the inner floor member 38, they overlap on the edges. This will occur only while pipe fills the circular slots 28 and 30.

Figure 5:
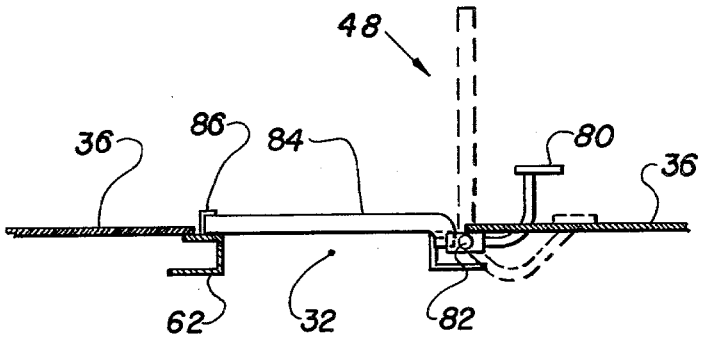
FIG. 5 is a side sectional view of the elongated slot and latch thereof.

At the entrance or adjacent the string or the derrick side of the elongated feed slot 32 said latch 48 is shown in FIG. 5 (in broken line in an open position). The foot step 80 must be depressed manually so that bolt 84 raises out of and above the elongated feed slot 32. The bolt 84 pivots at a hinge pin 82 which is positioned below the outer floor member 36. When the foot step 80 is released, the bolt 84 falls onto the outer floor member 36 on the other side of the slot 32 and fits into guide block 86 shown in FIG. 2. Therefore, unless a workman wants drill pipe to enter or exit the feed slot 32, there is no way for the pipe to move out of the slot. Edges of the elongated feed slots 32 and 34 are reinforced by channel members. Inasmuch as the same material as forms the tracks 62 and 64 is used for this reinforcing channel member, the channel members have been designated on the drawings by the numeral 62.

Figure 6:
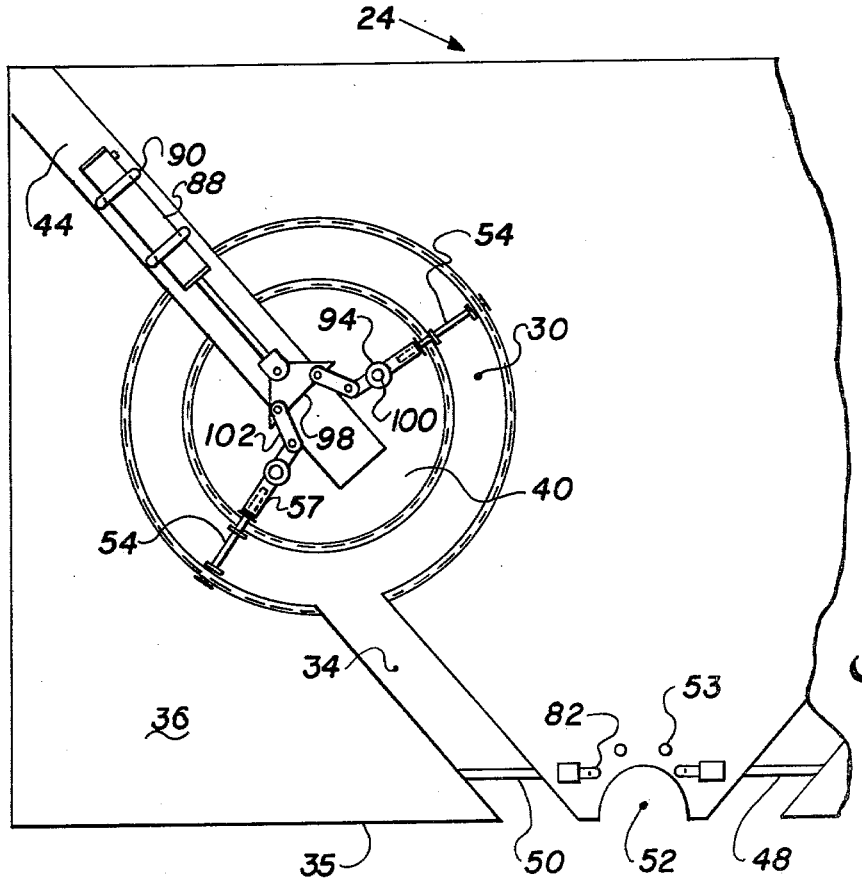
FIG. 6 is a partial bottom plan view thereof.

Mechanical means for moving the pipe around the circular storage slot 28 by the swing arm assembly 54 is illustrated in FIG. 6. An air or other fluid cylinder 88 is connected by U-bolts 90 to the beam 44. An air supply line runs along the beam 42 to the air switch 53 and an air compressor (not shown). The cylinder 88 is controlled by the workman 26 with the switch. The details of the air supply line and compressor are not shown for conciseness since they would be within the skill of ordinary workmen. The swing arm assembly 54 is pivoted to member 40 by turntable 94. Links 102 pivot freely at plate 98 on the rod of cylinder 88, which moves along the beam 44 as the air pressure varies. The turntable 94 utilizes pivot pin 100 to rotate and move the swing arm tube 57 as the link 102 moves. As the swing arm assembly 54 travels along the circular slot 30, the swing telescoped arm 60 must telescope to accomodate the varying length. The swing arm assembly 54 sweeps the slot 28 from the beam 42 to the juncture of the feed slot 32. Therefore, a workman 26 is able to efficiently remove the drill pipe stands 17 in the circular slots and prevent the pipe from falling out of the slots. Since the doors, such as door 46, provide a solid working board platform when pipe is not present, the risk of industrial accident is greatly reduced.

Analysis will show that the combined length of the slots must be at least equal to the total diameter of one half the stand of drill pipe in the string if all the pipe is racked double file. If all the pipe is to be racked single file, then the combined length of the slots needs to be at least equal to the total diameter of all the stands.

The embodiment shown and described above is only exemplary. I do not claim to have invented all the parts, elements to steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

10 derrick
12 crown block
14 traveling block
16 drill pipe string
17 drill pipe stands
18 rotary table
20 drilling floor
22 ground
24 working board
26 workman
28 arcuate storage slot
30 arcuate storage slot
32 elongated feed slot
34 elongated feed slot
36 outer floor member
38 inner floor member
40 inner floor member
42 beam
44 beam
46 door
48 latch
50 latch
52 cow catcher
53 air switch
54 swing arm assembly
55 air switch
57 tube
58 rollers
60 swing telescoped arm
62 track
64 track
66 holder plate
70 protector sleeve
72 tubing
73 extension arm
74 cold roll bar
75 pipe guides
76 plate
80 foot step
82 hinge pin
84 latch bolt
86 guide block
88 air cylinder
90 U-bolt
94 turntable
98 plate
100 pivot pin
102 connecting links

SUBJECT MATTER CLAIMED FOR PROTECTION

I claim as my invention:

1. A platform for handling oil well pipe
a. located at a high elevation in a drilling derrick, and
b. for connecting, disconnecting and racking stands of drill pipe to and from a drill string;
wherein the improvement comprises:
c. a main floor member with an elongated feed slot extending inwardly to
d. an arcuate slot,
e. an inner platform floor with said arcuate slot supported by
f. a beam from the main floor member,
g. a mechanical latch in said elongated feed slot to allow storage and removal of said pipe in the open position and to prevent the accidental escape of the pipe when closed, and
h. pipe pushers which move within said arcuate slot and mechanically move said pipe toward the elongated slot.

2. The invention as defined in limitations a. through h. of claim 1 further comprising:
i. said pipe pushers pivoted to the inner floor, and
j. fluid cylinder means connected to the pipe pushers for moving said pipe pushers.

3. The invention as defined in limitations a. through j. of claim 2 further comprising:
k. pipe slot doors hinged to the inner floor which cover the arcuate slot when vacant of said pipe and open onto said inner floor when said pipe is racked into said arcuate slot.

4. In an oil well drilling rig having
a. a derrick with a
b. crown block at the top suspending a
c. traveling block below the crown block,
d. a drilling floor with
e. a rotary table thereon,
f. a string of drill pipe having a certain diameter suspended from the traveling block through the rotary table,
g. a working board on the derrick, above the drilling floor and below the crown block, for a workman to stand upon while connecting and disconnecting stands of said drill pipe to and from the string and racking the stands into said working board on a side of the working board adjacent said string,
h. a main floor on the working board, and
i. means for attaching said main floor to said derrick;
the improved working board comprising:
j. an inner floor on the working board,
k. support means for supporting the inner floor from the main floor with sufficient rigidity that said workman may walk thereon while performing his tasks,
l. an arcuate slot between the main floor and inner floor,
m. said slot having sufficient width to receive one of the stands of drill pipe therein, and
n. a feed slot connecting said arcuate slot to the derrick side of the working board adjacent the string of drill pipe.

5. The invention as defined in limitations a. through n. of claim 4 further comprising:
o. said slots having a width greater than the diameter of said drill pipe and less than thrice said diameter.

6. The invention as defined in limitations a. through n. of claim 4 further comprising:
o. the combined length of the slots being at least equal to the total of the diameters of one half the stands of drill pipe in the string.

7. The invention as defined in limitations a. through n. of claim 4 further comprising:

o. a mechanical latch at the derrick side of said feed slot to allow storage and removal of said pipe stands.

8. The invention as defined in limitations a. through n. of claim 4 further comprising:

o. pipe pushers in the arcuate slot which move along said arcuate slots and mechanically move said pipe to the feed slot.

9. The invention as defined in limitations a. through o. of claim 8 further comprising:

p. said pipe pushers pivoted to the inner floor, and q. fluid cylinder means connected to the pipe pushers for moving said pipe pushers.

10. The invention as defined in limitations a. through n. of claim 4 further comprising:

o. pipe slot doors hinged to the inner floor which cover the arcuate slot when vacant of said pipe and open onto said inner floor when said pipe is racked into said arcuate slot.

11. The invention as defined in limitations a. through n. of claim 4 further comprising:

o. said arcuate slot being circular, and p. said inner floor being a circle.

12. The invention as defined in limitations a. through n. of claim 4 further comprising:

o. two inner floors, and two arcuate slots and two feed slots.

13. In an oil well drilling rig having a. a derrick with a b. crown block at the top suspending a c. traveling block below the crown block, d. a drilling floor with e. a rotary table thereon, f. a string of drill pipe having a certain diameter suspended from the traveling block through the rotary table, g. a working board on the derrick, above the drilling floor and below the crown block, for a workman to stand upon while connecting and disconnecting stands of said drill pipe to and from the string and racking the stands into said working board on a side of the working board adjacent said string, h. a main floor on the working board, and i. means for attaching said main floor to said derrick; the improved working board comprising:

j. a feed slot in the board extending from the side adjacent the string, k. storage slots in the board extending from said feed slot, l. all of said slots having sufficient width to receive one of the stands of drill pipe therein, and the width of all said slots less than three times the pipe diameter, m. pipe pushers in the slots which move along said slots and mechanically move said pipe to the side, adjacent the string.

14. The invention as defined in limitations a. through m. of claim 13 further comprising:

n. a mechanical latch at the derrick side of said feed slot to prevent accidental escape of said pipe.

15. The invention as defined in limitations a. through n. of claim 14 further comprising:

o. fluid cylinder means connected to the pipe pushers for moving said pipe pushers.

16. The invention as defined in limitations a. through o. of claim 15 further comprising:

p. pipe slot doors hinged to the board which cover the storage slots when vacant of said pipe and open onto said working board when said pipe is racked into said feed slots.

* * * * *